United States Patent [19]

Kronberger

[11] Patent Number: 4,928,886

[45] Date of Patent: May 29, 1990

[54] FUEL INJECTION NOZZLE

[75] Inventor: Maximilian H. Kronberger, Steyr, Austria

[73] Assignee: Voest-Alpine Automotive Gesellschaft M.B.H., Linz, Austria

[21] Appl. No.: 415,470

[22] Filed: Oct. 2, 1989

Related U.S. Application Data

[63] Continuation of Ser. No. 151,301, Feb. 1, 1988, abandoned.

[30] Foreign Application Priority Data

Feb. 4, 1987 [AT] Austria ..... 228/87

[51] Int. Cl.[5] ..... F02M 61/16

[52] U.S. Cl. ..... 239/533.5

[58] Field of Search ..... 239/533.3–533.12

[56] References Cited

U.S. PATENT DOCUMENTS

| | | | |
|---|---|---|---|
| 2,420,550 | 5/1947 | Miller | 239/533.8 X |
| 3,403,861 | 10/1968 | Eidtmann et al. | 239/533.5 |
| 3,481,542 | 12/1969 | Huber | 239/533.8 |
| 3,796,379 | 3/1974 | Fenne | 239/533.8 |
| 4,566,635 | 1/1986 | Trachte | 239/533.8 |

FOREIGN PATENT DOCUMENTS

| | | | |
|---|---|---|---|
| 487403 | 10/1952 | Canada . | |
| 0178427 | 4/1986 | European Pat. Off. . | |
| 3521428 | 12/1986 | Fed. Rep. of Germany . | |
| 23375 | 2/1980 | Japan | 239/533.8 |
| 6155362 | 3/1986 | Japan | 239/533.5 |
| 634030 | 3/1950 | United Kingdom | 239/533.5 |
| 2140505 | 3/1983 | United Kingdom | 239/533.5 |
| 2189596 | 4/1986 | United Kingdom . | |

*Primary Examiner*—Andres Kashnikow
*Assistant Examiner*—Kevin P. Weldon
*Attorney, Agent, or Firm*—Cushman, Darby & Cushman

[57] ABSTRACT

A fuel injection nozzle, in particular pump nozzle, includes a nozzle needle loaded by a spring in the closing sense. The nozzle has a pressure space, located upstream the seat of the nozzle needle, in open connection with the storage space of a yield piston. The yield piston is shiftable within a guide bore and loaded by a spring in direction towards the storage space. The yield piston is subjected at its piston surface, located opposite the storage space to the pressure prevailing within an attenuating space, which can be filled with fuel. The attenuating space is, via a throttle cross-section, in connection with an outlet and/or with another space.

8 Claims, 5 Drawing Sheets

FIG. 5
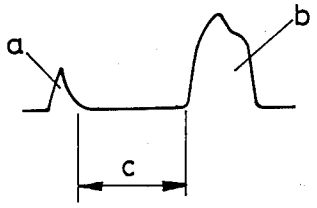
FIG. 6
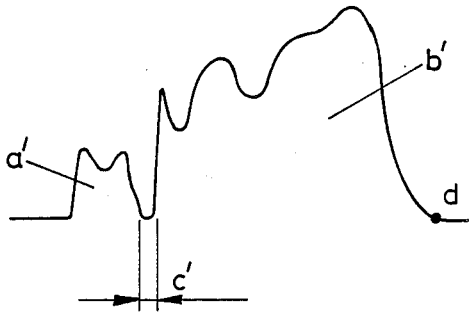
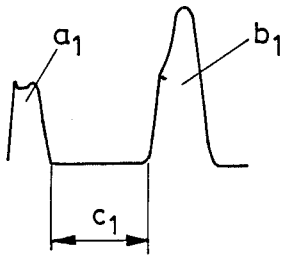
FIG. 7
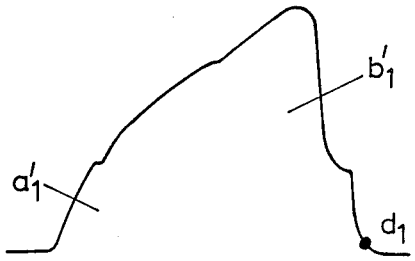
FIG. 8

FUEL INJECTION NOZZLE

This is a continuation of Application Ser. No. 07/151,301, filed Feb. 1, 1988, which was abandoned upon the filing hereof.

BACKGROUND OF THE INVENTION

1. Field of the Invention

The invention refers to a fuel injection nozzle, in particular a pump nozzle comprising a nozzle needle being loaded by a spring in a closing sense, in which the pressure space located upstream the seat of the nozzle needle is in open connection with the storage space of a yield piston being shiftable within a guide bore and being loaded by a spring in a direction towards the storage space. The term "pump nozzle" is used in this case to denote an injection means in which the injection nozzle is connected with the pump piston bushing and the pump piston to form one single constructional unit.

2. Description of the Prior Art

A device of the initially mentioned type may, for example, be derived from DE-OS 34 09 924. The arrangement of the yield piston, which is connected in parallel to the nozzle needle with respect to the action of the pressurized fluid, serves, in this case, the purpose to subdivide the fuel injection step into a preliminary injection step and a separate main injection step. For this purpose, the nozzle needle is first lifted against the force of the nozzle needle spring on occasion of a pressure rise within the pressure conduit for the fuel, whereby the injection step is started. Thereafter, also the yield piston is shifted against the force of the nozzle needle spring on account of the pressure rise within the pressure conduit, whereby, on the one hand, the spring force acting on the nozzle needle spring is increased and, on the other hand, the pressure is reduced for a short time interval on account of the activated yield volume of the pressure reduction results in the nozzle needle assuming a closed position for a short time. The pressure becoming increased thereafter is then in the position to lift against the nozzle needle against the pressure of the now stronger prestressed nozzle needle spring, so that the main injection step is started. The amount of fuel injected during the preliminary injection step is now strongly dependent on the rotational speed. With the engine rotating with the desired low idle speed, the yield piston has at disposal a longer time interval for effecting its yielding movement, so that the preliminary injected fuel amount is too strongly reduced, while the preliminary injected fuel amount is increased at higher rotating speeds, relative to the preliminary injected fuel amount as is injected in case of idle speed. This is not desired, because this results in noise generation at a low speed and in an incomplete combustion at high speeds. Also, the time interval between the end of the preliminary injection step and the beginning of the main injection step is not well adapted to the duration of the ignition delay. This time interval shall become shorter with increasing rotational speed and shall vanish at a definite rotational speed. The same applies also in case of increasing load. This is to mean that this time interval shall become zero within a definite area in the motor performance graph. This is not the case in the known arrangement, which gives rise to an excessive long duration of the total injection step, which results in an incomplete combustion. Furthermore, the yield piston, nozzle needle spring and nozzle needle form an oscillatory system, which is subject to become vibratory within a broad range of rotational speeds of a Diesel engine. Oscillations of the yield piston and of the nozzle needle result, irrespective of the increased mechanical stress, in a reduced fuel supply during the main injection step, which results in a longer duration of the main injection step. From AT-PS 292 382, it has become known to provide a throttling means within the conduit leading to the storage space of the yield piston. However, this is disadvantageous because the opening pressure is influenced by this throttling means and because formation of gas bubbles is caused, which changes the compressibility of the fluid within the storage space. Thus, it becomes difficult to control the volumetric amount of fuel flowing into the storage space of the yield piston.

SUMMARY OF THE INVENTION

The invention aims at reliably providing an optimum injection pattern within the total range of rotational speeds and within the whole performance graph, respectively. For this purpose, the invention essentially consists in that the yield piston is subjected at its piston surface located opposite the storage space to the pressure prevailing within an attenuating space which can be filled with fuel and which is connected via a throttling cross-section with an outlet and/or with another space. On account of the attenuation of the movement of the yield piston, the yielding movement of the yield piston is reduced in case of idle speed. The preliminary injected fuel amount is increased in case of idle speed, which results in a reduction of the preliminary injected fuel amount injected at higher rotational speeds relative to the amount of fuel preliminary injected in case of idle speed. Thus, there results an approximately constant amount of preliminary injected fuel and with increasing load or rotational speed there is reduced the time interval between the preliminary injection step and the main injection step, this which time interval may completely vanish with high rotational speed and high load, so that an uninterrupted injection step becomes possible. This results in a continuous character of the injection step and, thus, in a short injection period. On account of the attenuating means, any oscillations of the yield piston, the nozzle needle spring and the nozzle needle are reduced or avoided, which results also in a low mechanical load. On account of preventing or reducing the oscillations, there results a better throughput of the amount of injected fuel, which results in a reduction of the injection period. As a whole, there results a reduction of the emission of noxious matter. On account of the attenuating means, the yield piston can also be given a greater cross-section, which results in a more favourable injection diagram. According to the invention, the throttle opening is preferably adjustable, which provides the possibility to effect an adaptation to various types of motors. In this case the outlet from the attenuating space may be in connection with the suction space of the pump.

According to the invention, the attenuating space is conveniently in throttled connection with the pressure space for fuel located upstream the nozzle needle seat. This pressure space is in connection with the suction space of the pump element (inlet pressure). Filling of the attenuating space may, according to the invention may even be effected by an arrangement which one allows to fill the attenuating space with leaking fuel leaking between the yield piston and its guide bore. This results in the advantage, that separate connecting passages, which must be provided with throttling means, between the pressure space for fuel and the attenuating space are omitted.

According to the invention, the yield piston may be supported against the nozzle needle spring. This results, on the one hand, in omitting a separate spring for loading the yield piston and, on the other hand, the prestress of the nozzle needle spring is increased on occasion of the yielding movement of the yield piston, and closing movement of the nozzle needle is effected more rapidly.

According to a preferred embodiment of the invention, the yield piston is arranged within a separate part, which is clamped with the nozzle body, in particular with the part accomodating the nozzle needle spring, with interposition of a boundary plate delimiting the attenuating space. The throttle cross-section is formed by a hole within the boundary plate and by a pin of the yield piston extending into said hole. This provides a simple means for effecting an adaptation, for example to different motor types, by interchanging the boundary plate. However, according to a further preferred embodiment of the invention, the arrangement is selected such that the hole is circular in shape and that the pin has a circular cross-section and is provided with a lateral chamferring. In this case, the cylindrical pin can be sufficiently precisely adapted to the diameter of the hole provided in the boundary plate, and the throttle cross-section is essentially only defined by the chamferring of the cylindrical pin. This provides for a more precise calibration of the throttle cross-section, because any tolerance of the chamferring has an only linear influence on the throttle cross-section. When calibrating the throttle cross-section by changing the diameter of the hole in the boundary plate with the diameter of the pin remaining the same, any tolerance would influence the calibration with the second power of the diameter difference. If calibration of the throttle cross-section is effected by chamferring the cylindrical pin, it is, however, necessary to interchange the yield piston together with the pin, if the calibration of the throttle cross-section is to be changed.

According to the invention, the attenuating space is preferably located within the yield piston bushing. Part of the attenuating space is formed by an annular depression surrounding the guide bore of the yield piston bushing. This provides the possibility to vary the size, and thus the effect, of the attenuating space, by interchanging the yield piston bushing.

According to the invention, it is convenient to arrange the hole within the center of the boundary plate to have a circular shape and to arrange the pin centrically on the yield piston. Because the pin centers the boundary plate, mounting of the boundary plate is facilitated. According to the invention, the yield piston is preferably supported by means of the pin against that spring washer which is located opposite the location of attack of the nozzle needle spring on the nozzle needle. This is made possible by centrically arranging the pin on the yield piston.

According to the invention, the yield piston may be arranged within the space accommodating the nozzle needle spring and embrace the nozzle needle spring in the axial direction, noting that the space accommodating the nozzle needle spring forms the attenuating space, and this provides a simple and a space-saving arrangement.

BRIEF DESCRIPTION OF THE DRAWING

In the drawing, the invention is illustrated with reference to examples of embodiment described in the specification. In the drawing:

FIGS. 5 and 6 show diagrams applicable to known embodiments in case of idle speed and higher rotational speeds and FIGS. 7 and 8 show diagrams applicable to an embodiment according to the invention in case of idle speed and high rotational speed.

DETAILED DESCRIPTION OF THE DRAWING

Figure 1:
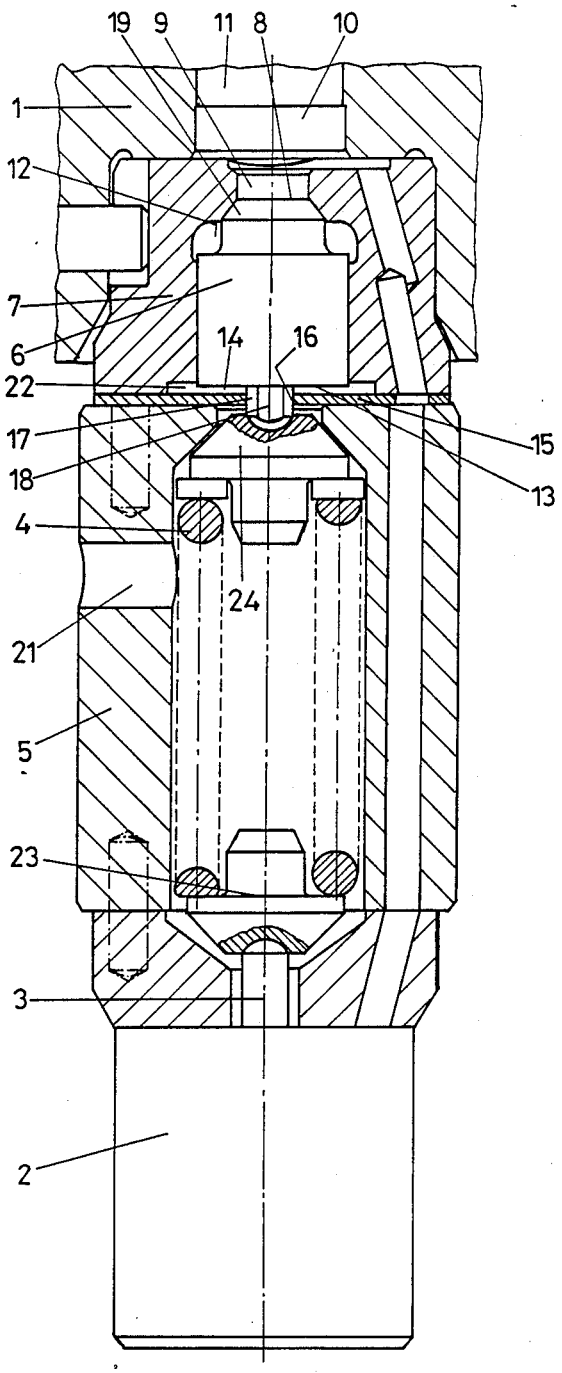
FIG. 1 shows an axial section through a pump nozzle.
Figure 2:
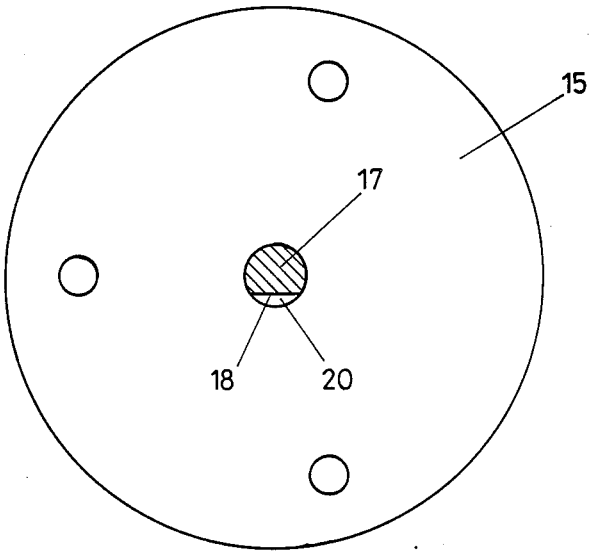
FIG. 2 shows a top plan view of the boundary plate.

In the arrangement according to FIGS. 1 and 2, reference numeral 1 represents the pump piston bushing, reference numeral 2 represents the nozzle body accommodating the nozzle needle 3 and reference numeral 4 represents the nozzle needle spring being arranged within a constructional part 5 being clamped with the pump piston bushing. Reference numeral 6 represents the yield piston and reference numeral 7 represents the yield piston bushing. The front surface 8 of the yield piston 6 is, via a bore 9, subjected to the pressure prevailing within the working chamber 10 of the pump piston 11, being guided within the pump piston bushing 1. Reference numeral 12 represents the storage space within the yield piston bushing 7. The storage space is in connection with the working chamber 10 if the yield piston 6 is in a lifted position. The piston surface 13 of the yield piston 6 is located opposite its front surface 8 and is subjected to the pressure prevailing within an attenuating space 14. The attenuating space 14 may also be filled by leaking fuel passing the gap between the yield piston 6 and the yield piston bushing 7.

A boundary plate 15 is clamped between the yield piston bushing 7 and the constructional part 5 accommodating the nozzle needle spring 4 and delimits the attenuating space 14 at one end. The boundary plate 15 has a central bore 16, into which extends a cylindrical pin 17 forming one single part with the yield piston 6. The cylindrical pin 17 fits into the bore 16. This cylindrical pin has on one side a chamferring 18, the depth of which defines a throttle cross-section between the pin and the bore 16 of the boundary plate 15. During the yielding movement of the yield piston 6, i.e. if the cone 19 is lifted off the bore 9, the yield piston 6 is urged, under the action of the pressure prevailing within the storage space 12, in a direction towards the nozzle needle spring 4. The movement of said yield piston is attenuated by the pressure prevailing within the attenuating space 14. In this case, the fuel flowing out of the throttle opening 20 can flow off through the spring chamber and the outlet 21. As soon as the closing pressure has been attained, the yield piston 6 is pressed in upward direction by the nozzle needle spring 4. The attenuating space 14 becomes thereby filled with fuel coming from the spring chamber. A substantially longer time interval is at disposal for this action than for expelling the fuel out of the attenuating space 14, so that a small pressure difference is most frequently sufficient for overcoming the throttle opening 20. The yield piston bushing 7 has an annular depression 22 surrounding the yield piston 6 and increasing the capacity of the attenuating space 14.

The boundary plate 15 and also the yield piston 6 are interchangeable for respective others, so that it is possible to change the calibration of the throttle opening 20 to effect an adaptation to different motor types.

The yield piston 6 is supported by means of the central pin 17 against that spring washer 24, which is located opposite the point 23 of attack at the nozzle needle 3.

Figure 3:
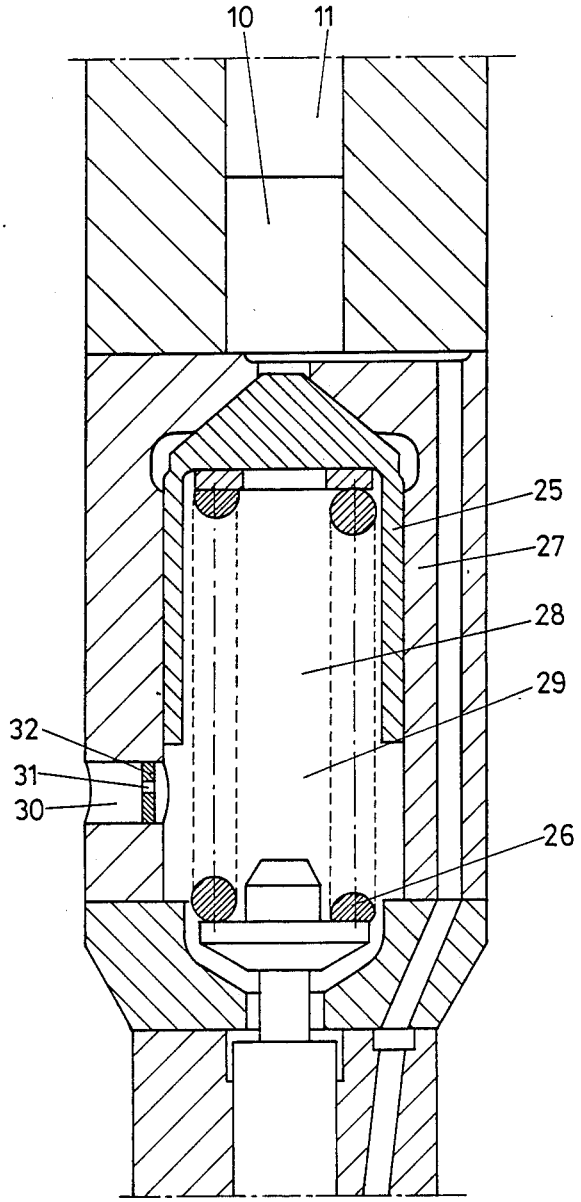
FIGS. 3 and 4 show axial sections through other embodiments of a pump nozzle.
Figure 4:
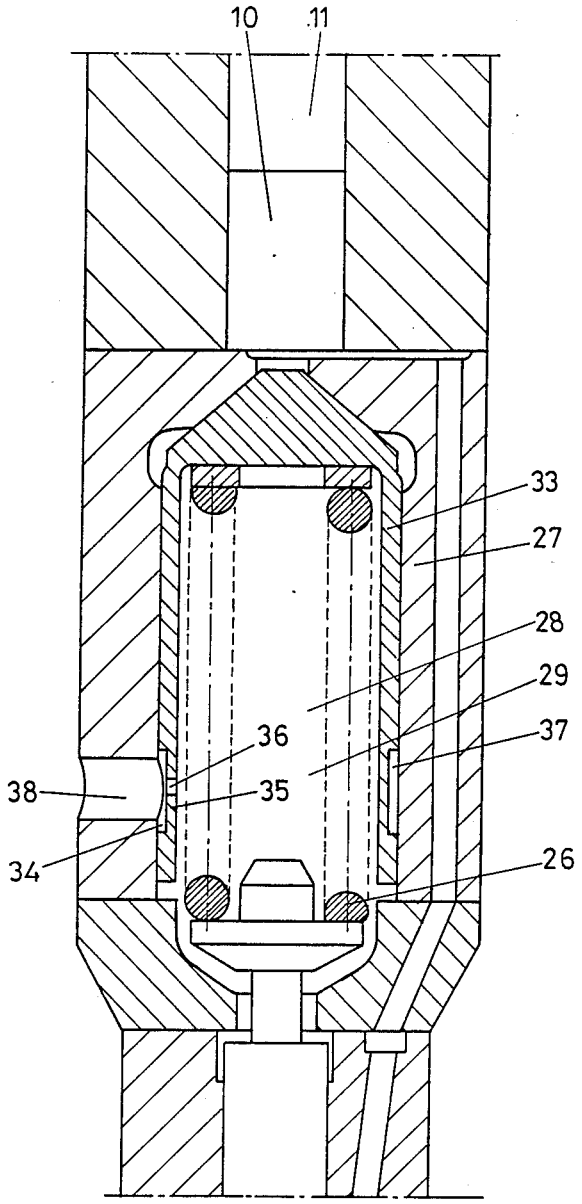

In the embodiment according to FIG. 3, the yield piston 25 is supported against the nozzle needle spring 26. The component part 27 accommodating the nozzle needle spring is, in this case, acting as the yield piston bushing. The space 28 housing the nozzle needle spring is filled with fuel and thus acts as attenuating space 29. Fuel can now flow out of this attenuating space 29 via an outlet 30, and a calibrated bore 31 provided in a throttle member 32 which is inserted into the outlet 30, which results in an attenuating effect. The embodiment according to FIG. 4 differs from the embodiment according to FIG. 3, in that the yield piston 33 has a perforation 34 into which is inserted a throttle member 35 being provided with a calibrated bore 36. The perforation 34 opens into an annular groove 37 provided in the yield piston 33 and the perforation 34 is, via the annular groove, in connection with the outlet 38 in all rotational positions of the yield piston 33.

The diagrams according to FIGS. 5 and 6 show the time-dependent injection pattern according to the prior art. The diagram according to FIG. 5 represents the injection pattern in case of idle speed and the diagram according to FIG. 6 represents the injection pattern in case of maximum rotational speed and of maximum load. The amount of injected fuel is plotted at the ordinate and the injection time is plotted at the abscissa. In the diagram according to FIG. 5, the preliminary injection step is designated by a and the main injection step is designated by b. A time interval c exists between the preliminary injection step a and the main injection step b. In the diagram according to FIG. 6, a′ represents the preliminary injection step and b′ represents the main injection step. The time interval c′ is shorter, but still existent. As is shown by the diagram according to FIG. 6, the curve is not smoothly progressing for the preliminary injection step a′, as well as for the main injection step b′. The waves have their origin in unattenuated oscillations of the yield piston, the nozzle needle spring and the nozzle needle. On account of these waves, there results a prolonged injection pattern, injection being finished at the point d.

The diagrams according to FIGS. 7 and 8 show the injection pattern for an arrangement according to the invention. At idling speed (diagram according to FIG. 7), $a_1$ represents the preliminary injection step and $b_1$ represents the main injection step. It can be seen that in an arrangement according to the invention the preliminary injection step $a_1$ is of longer duration than in the diagram according to FIG. 5 when related to the main injection step $b_1$. In case of idle speed, the preliminary injection step $a_1$ is thus shortened relative to the main injection step $b_1$. In the diagram according to FIG. 8, which is concerned with the inventive arrangement under the conditions of maximum load and nominal rotational speed, the preliminary injection step $a_1$ completely passes over into the main injection step $b_1$, i.e. the time interval c′ according to FIG. 6 has completely vanished. As shown the diagrams according to FIGS. 7 and 8, the progress of the pattern is smooth and complete and free of interruptions on account of suppressing any oscillations of the yield piston, nozzle needle spring and nozzle needle. The fuel is thus injected within a shorter time interval and the injection step is already finished at the point $d_1$.

What is claimed is:

1. A fuel injection pump nozzle, comprising:

longitudinally elongated housing means having an axial bore including at an upstream end an inlet for exposure, in use, to fuel under pressure, and at a downstream end an outlet for delivering fuel to a combustion chamber of an engine;

means defining a needle valve seat in said bore of said housing means;

a valve needle longitudinally slidably received in said bore for opening and closing said outlet by sliding out of and into seating relation with said needle valve seat;

a spring means received in said axial bore and urging said valve needle axially downstream towards said seating relation with said needle valve seat;

surface means on said valve needle subject to fuel pressure in said bore for longitudinally temporarily moving said valve needle for opening said bore to dispense fuel through said outlet;

means defining a yield piston seat in said bore of said housing means upstream from said needle valve seat;

a yield piston longitudinally slidably received in said bore between said valve needle and said yield piston seat for opening and closing said bore between said inlet and said needle valve seat;

a fuel bore having an inlet end communicated with said axial bore upstream of said yield piston seat and an outlet end communicated with said axial bore at said needle valve seat, whereby pressurized fuel can flow from upstream of said yield piston seat to said outlet of said axial bore of said housing means, through said fuel bore, only when said valve needle is slid out of seating relation with said needle valve seat;

surface means on said valve needle subject to fuel pressure in said fuel bore for longitudinally temporarily moving said valve needle for opening communication of said fuel bore to said axial bore at said needle valve seat to dispense fuel through said outlet;

said yield piston including a longitudinally extending outer peripheral sidewall portion extending downstream from an annular sealing surface thereof, said sealing surface being arranged to contact said yield piston seat for closing said axial bore; said yield piston further including a piston surface axially opposed to said annular sealing surface and located downstream of said annular sealing surface; said yield piston further including an end surface facing axially towards upstream and exposed to said axial bore upstream of said yield piston seat, whereby fuel inlet pressure is communicated to said yield piston through said inlet of said axial bore;

said spring means received in said axial bore also urging said yield piston axially upstream towards said yield piston seat;

means defining a fuel drain outlet from said axial bore of said housing means between said yield piston seat and said valve needle seat;

means defining a storage space in said axial bore surrounding said yield piston and being located between said peripheral sidewall portion and said annular sealing surface of said yield piston when said yield piston is disposed in closing relation to said axial bore;

throttle plate means disposed effectively between said yield piston and said fuel drain outlet, said throttle plate means having an opening therethrough which is more restricted in volumetric throughput capacity per unit time than is said fuel drain outlet, whereby said axial bore, between said yield piston and said throttle plate means defines an attenuation space containing said piston surface, which attenuation space, when filled with fuel modulates how rapidly said yield piston can move longitudinally in said bore in relation to said yield piston seat, whereby yielding movement of the yielding piston is reduced during engine idling; and means defining a pathway for admitting pressurized fuel to said axial bore downstream of said yield piston seat, for filling said attenuation space;

said pathway comprising a fuel leakage pathway defined between said peripheral sidewall portion of said yield piston and said axial bore, whereby fuel admitted to said storage space when said yield piston is disposed in open relation to said axial bore may leak around said yield piston in said axial bore to downstream of said yield piston for filling said attenuation space.

2. The fuel injection pump nozzle of claim 1, wherein:

said spring means is provided by a spring effectively bearing in axially opposite directions against said nozzle needle and said yield piston.

3. The fuel injection pump nozzle of claim 2, wherein:

said throttle plate means comprises a boundary plate provided across said axial bore; means defining a hole axially through said boundary plate; and an axial pin on said yield piston received in said hole; said pin having a smaller transverse cross-sectional area than said hole, whereby a throttled communication between said attenuation space, upstream of said throttle plate means, and said axial bore, downstream of said throttle plate means is provided through said boundary plate;

said spring bearing at one end thereof against a spring washer, and said spring washer bearing against an end of said pin and thereby against said yield piston.

4. A fuel injection pump nozzle, comprising:

longitudinally elongated housing means having an axial bore including at an upstream end an inlet for exposure, in use, to fuel under pressure, and at a downstream end an outlet for delivering fuel to a combustion chamber of an engine;

means defining a needle valve seat in said bore of said housing means;

a valve needle longitudinally slidably received in said bore for opening and closing said outlet by sliding out of and into seating relation with said needle valve seat;

a spring means received in said axial bore and urging said valve needle axially downstream towards said seating relation with said needle valve seat;

surface means on said valve needle subject to fuel pressure in said bore for longitudinally temporarily moving said valve needle for opening said bore to dispense fuel through said outlet;

means defining a yield piston seat in said bore of said housing means upstream from said needle valve seat;

a yield piston longitudinally slidably received in said bore between said valve needle and said yield piston seat for opening and closing said bore between said inlet and said needle valve seat;

a fuel bore having an inlet end communicated with said axial bore upstream of said yield piston seat and an outlet end communicated with said axial bore at said needle valve seat, whereby pressurized fuel can flow from upstream of said yield piston seat to said outlet of said axial bore of said housing means, through said fuel bore, only when said valve needle is slid out of seating relation with said needle valve seat;

surface means on said valve needle subject to fuel pressure in said fuel bore for longitudinally temporarily moving said valve needle for opening communication of said fuel bore to said axial bore at said needle valve seat to dispense fuel through said outlet;

said yield piston including a longitudinally extending outer peripheral sidewall portion extending downstream from an annular sealing surface thereof, said sealing surface being arranged to contact said yield piston seat for closing said axial bore; said yield piston further including a piston surface axially opposed to said annular sealing surface and located downstream of said annular sealing surface; said yield piston further including an end surface facing axially towards upstream and exposed to said axial bore upstream of said yield piston seat, whereby fuel inlet pressure is communicated to said yield piston through said inlet of said axial bore;

said spring means received in said axial bore also urging said yield piston axially upstream towards said yield piston seat;

means defining a fuel drain outlet from said axial bore of said housing means between said yield piston seat and said valve needle seat;

throttle plate means disposed effectively between said yield piston and said fuel drain outlet, said throttle plate means having an opening therethrough which is more restricted in volumetric throughput capacity per unit time than is said fuel drain outlet, whereby said axial bore, between said yield piston and said throttle plate means defines an attenuation space containing said piston surface, which attenuation space, when filled with fuel modulates how rapidly said yield piston can move longitudinally in said bore in relation to said yield piston seat, whereby yielding movement of the yielding piston is reduced during engine idling; and means defining a pathway for admitting pressurized fuel to said axial bore downstream of said yield piston seat, for filling said attenuation space;

said throttle plate means comprising a boundary plate provided across said axial bore; means defining a hole axially through said boundary plate; and an axial pin on said yield piston received in said hole; said pin having a smaller transverse cross-sectional area than said hole, whereby a throttled communication between said attenuation space, upstream of said throttle plate means, and said axial bore, downstream of said throttle plate means is provided through said boundary plate.

5. A fuel injection pump nozzle, comprising:

longitudinally elongated housing means having an axial bore including at an upstream end an inlet for exposure, in use, to fuel under pressure, and at a downstream end an outlet for delivering fuel to a combustion chamber of an engine;

means defining a needle valve seat in said bore of said housing means;

a valve needle longitudinally slidably received in said bore for opening and closing said outlet by sliding out of and into seating relation with said needle valve seat;

a spring means received in said axial bore and urging said valve needle axially downstream towards said seating relation with said needle valve seat;

surface means on said valve needle subject to fuel pressure in said bore for longitudinally temporarily moving said valve needle for opening said bore to dispense fuel through said outlet;

means defining a yield piston seat in said bore of said housing means upstream from said needle valve seat;

a yield piston longitudinally slidably received in said bore between said valve needle and said yield piston seat for opening and closing said bore between said inlet and said needle valve seat;

a fuel bore having an inlet end communicated with said axial bore upstream of said yield piston seat and an outlet end communicated with said axial bore at said needle valve seat, whereby pressurized fuel can flow from upstream of said yield piston seat to said outlet of said axial bore of said housing means, through said fuel bore, only when said valve needle is slid out of seating relation with said needle valve seat;

surface means on said valve needle subject to fuel pressure in said fuel bore for longitudinally temporarily moving said valve needle for opening communication of said fuel bore to said axial bore at said needle valve seat to dispense fuel through said outlet;

said yield piston including a longitudinally extending outer peripheral sidewall portion extending downstream from an annular sealing surface thereof, said sealing surface being arranged to contact said yield piston seat for closing said axial bore; said yield piston further including a piston surface axially opposed to said annular sealing surface and located downstream of said annular sealing surface; said yield piston further including an end surface facing axially towards upstream and exposed to said axial bore upstream of said yield piston seat, whereby fuel inlet pressure is communicated to said yield piston through said inlet of said axial bore;

said spring means received in said axial bore also urging said yield piston axially upstream towards said yield piston seat;

means defining a fuel drain outlet from said axial bore of said housing means between said yield piston seat and said valve needle seat;

throttle plate means disposed effectively between said yield piston and said fuel drain outlet, said throttle plate means having an opening therethrough which is more restricted in volumetric throughput capacity per unit time than is said fuel drain outlet, whereby said axial bore, between said yield piston and said throttle plate means defines an attenuation space containing said piston surface, which attenuation space, when filled with fuel modulates how rapidly said yield piston can move longitudinally in said bore in relation to said yield piston seat, whereby yielding movement of the yielding piston is reduced during engine idling; and means defining a pathway for admitting pressurized fuel to said axial bore downstream of said yield piston seat, for filling said attenuation space;

said throttle plate means comprising a boundary plate provided across said axial bore; means defining a hole axially through said boundary plate; and an axial pin on said yield piston received in said hole; said pin having a smaller transverse cross-sectional area than said hole, whereby a throttled communication between said attenuation space, upstream of said throttle plate means, and said axial bore, downstream of said throttle plate means is provided through said boundary plate;

said hole being circular and said pin being of laterally chamfered circular transverse cross-sectional shape.

6. A fuel injection pump nozzle, comprising:

longitudinally elongated housing means having an axial bore including at an upstream end an inlet for exposure, in use, to fuel under pressure, and at a downstream end an outlet for delivering fuel to a combustion chamber of an engine;

means defining a needle valve seat in said bore of said housing means;

a valve needle longitudinally slidably received in said bore for opening and closing said outlet by sliding out of and into seating relation with said needle valve seat;

a spring means received in said axial bore and urging said valve needle axially downstream towards said seating relation with said needle valve seat;

surface means on said valve needle subject to fuel pressure in said bore for longitudinally temporarily moving said valve needle for opening said bore to dispense fuel through said outlet;

means defining a yield piston seat in said bore of said housing means upstream from said needle valve seat;

a yield piston longitudinally slidably received in said bore between said valve needle and said yield piston seat for opening and closing said bore between said inlet and said needle valve seat;

a fuel bore having an inlet end communicated with said axial bore upstream of said yield piston seat and an outlet end communicated with said axial bore at said needle valve seat, whereby pressurized fuel can flow from upstream of said yield piston seat to said outlet of said axial bore of said housing means, through said fuel bore, only when said valve needle is slid out of seating relation with said needle valve seat;

surface means on said valve needle subject to fuel pressure in said fuel bore for longitudinally temporarily moving said valve needle for opening communication of said fuel bore to said axial bore at said needle valve seat to dispense fuel through said outlet;

said yield piston including a longitudinally extending outer peripheral sidewall portion extending downstream from an annular sealing surface thereof, said sealing surface being arranged to contact said yield piston seat for closing said axial bore; said yield piston further including a piston surface axially opposed to said annular sealing surface and located downstream of said annular sealing surface; said yield piston further including an end surface facing axially towards upstream and exposed to said axial bore upstream of said yield piston seat, whereby fuel inlet pressure is communicated to said yield piston through said inlet of said axial bore;

said spring means received in said axial bore also urging said yield piston axially upstream towards said yield piston seat;

means defining a fuel drain outlet from said axial bore of said housing means between said yield piston seat and said valve needle seat;

throttle plate means disposed effectively between said yield piston and said fuel drain outlet, said throttle plate means having an opening therethrough which is more restricted in volumetric throughput capacity per unit time than is said fuel drain outlet, whereby said axial bore, between said yield piston and said throttle plate means defines an attenuation space containing said piston surface, which attenuation space, when filled with fuel modulates how rapidly said yield piston can move longitudinally in said bore in relation to said yield piston seat, whereby yielding movement of the yielding piston is reduced during engine idling; and means defining a pathway for admitting pressurized fuel to said axial bore downstream of said yield piston seat, for filling said attenuation space;

said throttle plate means comprising a boundary plate provided across said axial bore; means defining a hole axially through said boundary plate; and an axial pin on said yield piston received in said hole; said pin having a smaller transverse cross-sectional area than said hole, whereby a throttled communication between said attenuation space, upstream of said throttle plate means, and said axial bore, downstream of said throttle plate means is provided through said boundary plate;

said attenuation space being greater in diameter than said yield piston.

7. A fuel injection pump nozzle, comprising:

longitudinally elongated housing means having an axial bore including at an upstream end an inlet for exposure, in use, to fuel under pressure, and at a downstream end an outlet for delivering fuel to a combustion chamber of an engine;

means defining a needle valve seat in said bore of said housing means;

a valve needle longitudinally slidably received in said bore for opening and closing said outlet by sliding out of and into seating relation with said needle valve seat;

a spring means received in said axial bore and urging said valve needle axially downstream towards said seating relation with said needle valve seat;

surface means on said valve needle subject to fuel pressure in said bore for longitudinally temporarily moving said valve needle for opening said bore to dispense fuel through said outlet;

means defining a yield piston seat in said bore of said housing means upstream from said needle valve seat;

a yield piston longitudinally slidably received in said bore between said valve needle and said yield piston seat for opening and closing said bore between said inlet and said needle valve seat;

a fuel bore having an inlet end communicated with said axial bore upstream of said yield piston seat and an outlet end communicated with said axial bore at said needle valve seat, whereby pressurized fuel can flow from upstream of said yield piston seat to said outlet of said axial bore of said housing means, through said fuel bore, only when said valve needle is slid out of seating relation with said needle valve seat;

surface means on said valve needle subject to fuel pressure in said fuel bore for longitudinally temporarily moving said valve needle for opening communication of said fuel bore to said axial bore at said needle valve seat to dispense fuel through said outlet;

said yield piston including a longitudinally extending outer peripheral sidewall portion extending downstream from an annular sealing surface thereof, said sealing surface being arranged to contact said yield piston seat for closing said axial bore; said yield piston further including a piston surface axially opposed to said annular sealing surface and located downstream of said annular sealing surface; said yield piston further including an end surface facing axially towards upstream and exposed to said axial bore upstream of said yield piston seat, whereby fuel inlet pressure is communicated to said yield piston through said inlet of said axial bore;

said spring means received in said axial bore also urging said yield piston axially upstream towards said yield piston seat;

means defining a fuel drain outlet from said axial bore of said housing means between said yield piston seat and said valve needle seat;

throttle plate means disposed effectively between said yield piston and said fuel drain outlet, said throttle plate means having an opening therethrough which is more restricted in volumetric throughput capacity per unit time than is said fuel drain outlet, whereby said axial bore, between said yield piston and said throttle plate means defines an attenuation space containing said piston surface, which attenuation space, when filled with fuel modulates how rapidly said yield piston can move longitudinally in said bore in relation to said yield piston seat, whereby yielding movement of the yielding piston is reduced during engine idling; and means defining a pathway for admitting pressurized fuel to said axial bore downstream of said yield piston seat, for filling said attenuation space;

said throttle plate means being provided in said fuel drain outlet from said axial bore of said housing means.

8. A fuel injection pump nozzle, comprising:

longitudinally elongated housing means having an axial bore including at an upstream end an inlet for exposure, in use, to fuel under pressure, and at a downstream end an outlet for delivering fuel to a combustion chamber of an engine;

means defining a needle valve seat in said bore of said housing means;

a valve needle longitudinally slidably received in said bore for opening and closing said outlet by sliding out of and into seating relation with said needle valve seat;

a spring means received in said axial bore and urging said valve needle axially downstream towards said seating relation with said needle valve seat;

surface means on said valve needle subject to fuel pressure in said bore for longitudinally temporarily moving said valve needle for opening said bore to dispense fuel through said outlet;

means defining a yield piston seat in said bore of said housing means upstream from said needle valve seat;

a yield piston longitudinally slidably received in said bore between said valve needle and said yield piston seat for opening and closing said bore between said inlet and said needle valve seat;

a fuel bore having an inlet end communicated with said axial bore upstream of said yield piston seat and an outlet end communicated with said axial bore at said needle valve seat, whereby pressurized fuel can flow from upstream of said yield piston seat to said outlet of said axial bore of said housing means, through said fuel bore, only when said valve needle is slid out of seating relation with said needle valve seat;

surface means on said valve needle subject to fuel pressure in said fuel bore for longitudinally temporarily moving said valve needle for opening communication of said fuel bore to said axial bore at said needle valve seat to dispense fuel through said outlet;

said yield piston including a longitudinally extending outer peripheral sidewall portion extending downstream from an annular sealing surface thereof, said sealing surface being arranged to contact said yield piston seat for closing said axial bore; said yield piston further including a piston surface axially opposed to said annular sealing surface and located downstream of said annular sealing surface; said yield piston further including an end surface facing axially towards upstream and exposed to said axial bore upstream of said yield piston seat, whereby fuel inlet pressure is communicated to said yield piston through said inlet of said axial bore;

said spring means received in said axial bore also urging said yield piston axially upstream towards said yield piston seat;

means defining a fuel drain outlet from said axial bore of said housing means between said yield piston seat and said valve needle seat;

throttle plate means disposed effectively between said yield piston and said fuel drain outlet, said throttle plate means having an opening therethrough which is more restricted in volumetric throughput capacity per unit time than is said fuel drain outlet, whereby said axial bore, between said yield piston and said throttle plate means defines an attenuation space containing said piston surface, which attenuation space, when filled with fuel modulates how rapidly said yield piston can move longitudinally in said bore in relation to said yield piston seat, whereby yielding movement of the yielding piston is reduced during engine idling; and means defining a pathway for admitting pressurized fuel to said axial bore downstream of said yield piston seat, for filling said attenuation space;

said throttle plate means being provided in said peripheral sidewall portion of said yield piston and said peripheral sidewall portion being located in radial juxtaposition with said fuel drain outlet from said housing means so that, in use, fuel draining from said axial bore through said fuel drain outlet does so through said throttle plate means.

* * * * *